US007982682B2

(12) United States Patent
Lee et al.

(10) Patent No.: US 7,982,682 B2
(45) Date of Patent: Jul. 19, 2011

(54) ANTENNA APPARATUS

(75) Inventors: Sung-Gyoo Lee, Tokyo (JP); Masahiko Nakamura, Chichibu-gun (JP); Eiichirou Hirose, Chichibu-gun (JP); Koji Yanao, Chichibu-gun (JP)

(73) Assignee: Mitsubishi Materials Corporation, Tokyo (JP)

( * ) Notice: Subject to any disclaimer, the term of this patent is extended or adjusted under 35 U.S.C. 154(b) by 301 days.

(21) Appl. No.: 12/306,614

(22) PCT Filed: Jun. 29, 2007

(86) PCT No.: PCT/JP2007/063142

§ 371 (c)(1),
(2), (4) Date: Dec. 24, 2008

(87) PCT Pub. No.: WO2008/001899

PCT Pub. Date: Jan. 3, 2008

(65) Prior Publication Data

US 2009/0273535 A1 Nov. 5, 2009

(30) Foreign Application Priority Data

Jun. 29, 2006 (JP) ..... 2006-180513

(51) Int. Cl.
*H01Q 1/48* (2006.01)

(52) U.S. Cl. ..... 343/848; 343/702

(58) Field of Classification Search ..... 343/702, 343/829, 846, 848
See application file for complete search history.

(56) References Cited

U.S. PATENT DOCUMENTS

| | | | | |
|---|---|---|---|---|
| 6,288,680 | B1 * | 9/2001 | Tsuru et al. | 343/702 |
| 6,380,903 | B1 * | 4/2002 | Hayes et al. | 343/725 |
| 6,421,016 | B1 * | 7/2002 | Phillips et al. | 343/702 |
| 6,486,852 | B1 | 11/2002 | Hirose et al. | |
| 2006/0290574 | A1 | 12/2006 | Tsai et al. | |

FOREIGN PATENT DOCUMENTS

| | | | |
|---|---|---|---|
| EP | 1329985 | A2 | 7/2003 |
| EP | 1703586 | A1 | 9/2006 |
| JP | 2004-241837 | A | 8/2004 |
| JP | 2005-079747 | A | 3/2005 |
| JP | 3758495 | B2 | 3/2006 |
| WO | WO 2005/064743 | A1 | 7/2005 |
| WO | WO 2006/18711 | A1 | 2/2006 |
| WO | WO 2006/290574 | A1 | 12/2006 |

OTHER PUBLICATIONS

European Search Report issued Mar. 22, 2010 for the corresponding European Patent Application No. 07767927.2.

* cited by examiner

*Primary Examiner* — Michael C Wimer
(74) *Attorney, Agent, or Firm* — Leason Ellis LLP.

(57) ABSTRACT

An antenna apparatus includes: a substrate; an RF ground conductor which is branched to extend in at least two directions and at least a part of which is formed on a surface of the substrate, the RF ground conductor functioning as an antenna ground plane; and an antenna portion, one end of which is connected to the RF ground conductor.

3 Claims, 3 Drawing Sheets

ANTENNA APPARATUS

CROSS-REFERENCE TO PRIOR RELATED APPLICATIONS

The present application is the U.S. National Stage of International Patent Application Serial No. PCT/JP2007/063142, filed on Jun. 29, 2007, which claims priority to Japanese Patent Application No. 2006-180513 filed Jun. 29, 2006, both of which are hereby incorporated by reference in their entirety.

FIELD OF THE INVENTION

The present invention relates to an antenna apparatus suitable for downsizing radio communication equipment.

BACKGROUND

In radio communication equipment such as mobile phones or note type personal computers with a built-in radio communication function, a packaging density of parts is increased as the radio communication equipment is reduced in size. To address this, an antenna apparatus as disclosed in, for example, Japanese Patent No. 3758495 is proposed. In this antenna apparatus, a spiral conductor layer is formed on the surface of a base material made of a dielectric material or a magnetic material. A so-called chip antenna is installed on a substrate, and the chip antenna is grounded to a ground plane formed on the substrate. In this case, as shown in for example FIG. 5, an RF ground conductor 3 to which a chip antenna 2 on a substrate 1 is grounded ideally requires the most area on the substrate 1 in order to gain sufficient antenna characteristics.

Furthermore, in recent years, with the digitalization of radio communication equipment, a circuit ground conductor 4 to be used as a digital circuit ground has been formed on a substrate 1 together with an RF ground conductor 3 to which a chip antenna 2 is grounded, to thereby allow the coexistence of the RF ground conductor 3 and the circuit ground conductor 4 on the same substrate 1, as shown in FIG. 6.

However, the prior art described above has problems as follows.

That is, in a quarter wave antenna in which an electrical length of the antenna element is ¼ of a wavelength (λ), the size (especially, the length) of the ground plane to which the antenna is grounded is important. However, with a higher packaging density of parts, it has become difficult to secure a sufficient ground area necessary to obtain antenna characteristics in an ideal condition as shown in FIG. 5.

Furthermore, in the case where the RF ground conductor 3 and the circuit ground conductor 4 coexist on the same substrate 1 as shown in FIG. 6, there is a disadvantage that the ground plane on the substrate 1 is divided, making it impossible to secure the necessary area for the RF ground conductor 3.

SUMMARY OF THE INVENTION

The present invention has been achieved in view of the aforementioned problems, and has an object to provide an antenna apparatus that is capable of obtaining the antenna characteristics similar to those in a case where an RF ground conductor is formed wide on a substrate, and also allows coexistence of the RF ground conductor and a circuit ground conductor on the same substrate.

The present invention adopts the following in order to solve the above problems.

An antenna apparatus of the present invention includes: an RF ground conductor which is branched to extend in at least two directions, at least a part of which is formed on a surface of the substrate, the RF ground conductor functioning as an antenna ground plane; and an antenna portion, one end of which is connected to the RF ground conductor.

In this antenna apparatus, the RF ground conductor is branched to extend in at least two directions. Therefore, in spite of the small ground area as a whole, the RF ground conductor extends in two directions to secure a length necessary for antenna characteristics. As a result, a radiation efficiency similar to that of a ground with one large area is obtained, making it possible to have sufficient antenna characteristics.

Furthermore, in the antenna apparatus of the present invention, it is preferable that the RF ground conductor be formed in an inverted L-shape branched in two directions orthogonal to each other. This antenna apparatus has the RF ground conductor branched in an inverted L-shape. Therefore, when a rectangular substrate is used, the RF ground conductor is arranged along a short edge and a long edge of the substrate. As a result, it is possible to effectively use the surface of the substrate. Furthermore, the RF ground conductor is branched in directions orthogonal to each other. This can contribute to antenna characteristics in an omnidirectional manner.

In the antenna apparatus of the present invention, it is preferable that the antenna portion be a chip antenna installed on the substrate, and that the RF ground conductor have, on the substrate: a first ground portion that extends along the chip antenna; and a second ground portion that extends in a direction orthogonal to an extension direction of the first ground portion and also in a direction of spacing apart from the first ground portion and the chip antenna. In this antenna apparatus, the RF ground conductor is made of: the first ground portion along the chip antenna; and the second ground portion perpendicular to the chip antenna. Therefore, the arrangement of the chip antenna in the arrangement relationship as described above makes it possible to obtain favorable antenna characteristics even in a small space.

Furthermore, in the antenna apparatus of the present invention, it is preferable that the RF ground conductor include: a substrate ground portion formed on the substrate; and an external ground portion, a base end of which is connected to the substrate ground portion and extends outside the substrate in a direction different from that of the substrate ground portion. In this antenna apparatus, the RF ground conductor is made of: the substrate ground portion; and the external ground portion. Therefore, in the case where a sufficient ground plane is not available on the surface of the substrate, it is possible to secure a ground length by use of the external ground portion such as a metal wire outside the substrate, to thereby obtain favorable antenna characteristics.

In the antenna apparatus of the present invention, it is preferable that a circuit ground conductor functioning as a digital circuit ground be formed on the surface of the substrate. In this antenna apparatus, the circuit ground conductor is formed on the substrate together with the RF ground conductor. This makes it possible to secure a sufficient area for the circuit ground conductor while maintaining the antenna characteristics.

According to the present invention, the following effects are produced.

That is, according to the antenna apparatus according to the present invention, the RF ground conductor is branched to extend in at least two directions. As a result, a radiation efficiency similar to that of a ground with one large area is obtained, making it possible to have sufficient antenna characteristics. Therefore, even if a circuit ground conductor functioning as a digital circuit ground is brought into coexistence with an RF ground conductor on the same substrate, sufficient antenna characteristics are obtained. As a result, it is possible to achieve a high packaging density of parts and a downsizing of radio communication equipment.

DETAILED DESCRIPTION OF THE INVENTION

Figure 1:
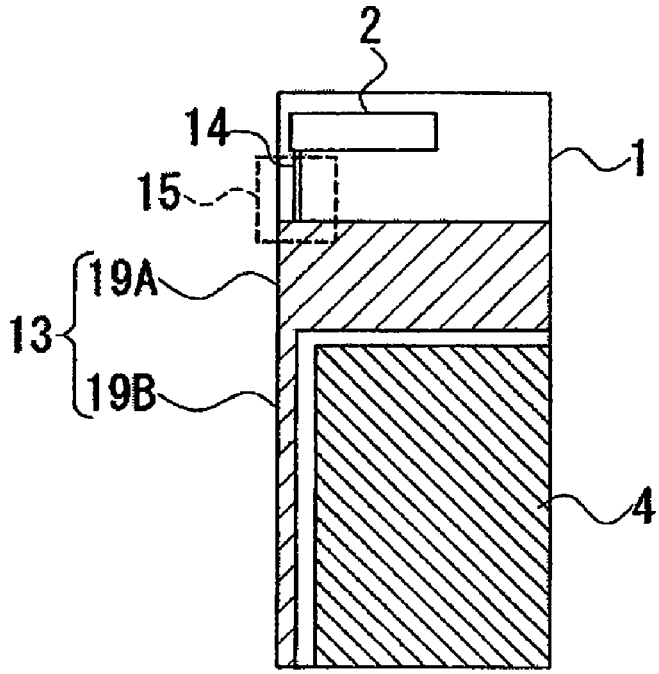
FIG. 1 is a plan view showing an antenna apparatus of a first embodiment according to the present invention.
Figure 2:
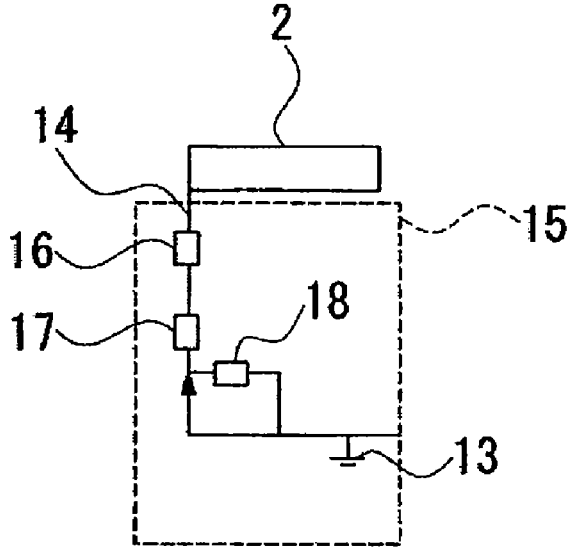
FIG. 2 is a circuit diagram showing a frequency regulation circuit in the first embodiment.
Figure 3:
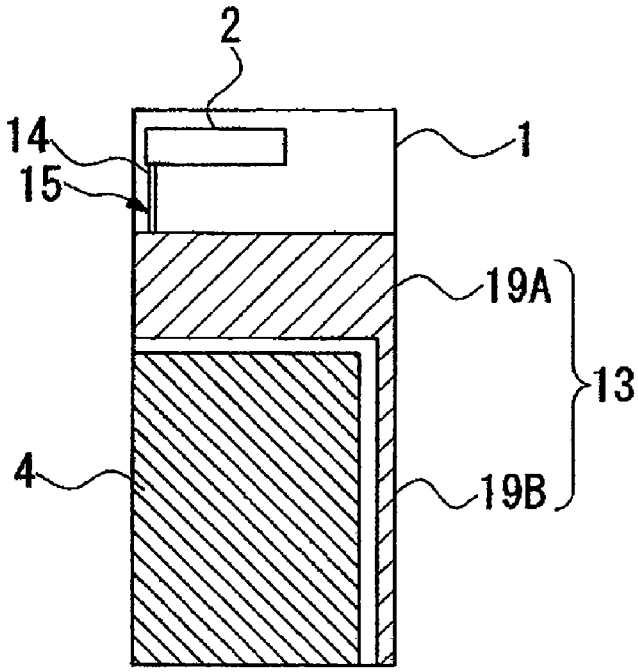
FIG. 3 is a plan view showing another example of an antenna apparatus in the first embodiment.

Hereunder is a description of an embodiment of an antenna apparatus according to the present invention, with reference to FIG. 1 to FIG. 3.

An antenna apparatus 1 of the present embodiment includes: a rectangular substrate 1; an RF ground conductor 13; a chip antenna (antenna portion) 2; and a circuit ground conductor 4. The substrate 1 is made of an insulative material such as a resin. The RF ground conductor 13 is formed on a surface of the substrate 1, and functions as an antenna ground plane. The chip antenna 2 has its one end connected to the RF ground conductor 13. The circuit ground conductor 4 is formed on the surface of the substrate 1, and functions as a digital circuit ground.

The above chip antenna 2 is an antenna element that functions as a loading element. It includes: a rectangular base material made of a dielectric such as, for example, an alumina; a linear conductor pattern that is wound in a spiral manner with respect to the longitudinal direction of a surface of this base material. This chip antenna 2 is installed at a position close to one of the short edges of the substrate 1 and spaced a predetermined distance apart from the RF ground conductor 13. It is fixed onto a land (not shown in the figure) formed at a predetermined position on the substrate 1. Furthermore, the chip antenna 2 is connected to the RF ground conductor 13 via a link conductor 14. Note that the conductor pattern of the chip antenna 2 has its one end connected to the link conductor 14.

Furthermore, to the link conductor 14, there is connected a frequency regulation circuit 15, as shown in FIGS. 1 and 2. This frequency regulation circuit 15 includes: a first inductor 16 and a second inductor 17 that are chip inductors connected in series to the chip antenna 2; and a third inductor 18 that is a chip inductor whose one end is connected to the second inductor 17 and whose other end is connected to the RF ground conductor 13. Furthermore, between the second inductor 17 and the third inductor 18, there is provided a feeding point. Note that the first inductor 16 and the second inductor 17 are for regulating resonant frequencies, and that the third inductor 18 is provided for reducing reflections of incident powers.

The above RF ground conductor 13 is for example pattern-formed on the substrate 1 with a copper foil or the like, and is also connected to a ground of a high-frequency circuit (not shown in the figure). The RF ground conductor 13 has a first ground portion 19A and a second ground portion 19B. The first ground portion 19A extends along the chip antenna 2. The second ground portion 19B extends in a direction orthogonal to an extension direction of the first ground portion 19A and also in a direction of spacing apart from the first ground portion 19A and the chip antenna 2. That is, the RF ground conductor 13 is formed in an inverted L-shape branched to extend in two directions orthogonal to each other. Note that the second ground portion 19B is arranged on the link conductor 14 side (in the figure, on the left side of the circuit ground conductor 4) along the circuit ground conductor 4.

In this manner, in the present embodiment, the RF ground conductor 13 is branched to extend in two directions as the first ground portion 19A and the second ground portion 19B. Therefore, in spite of the small ground area as a whole, the RF ground conductor 13 extends in two directions to secure a length necessary for the antenna characteristics. As a result, a radiation efficiency similar to that of a ground with one large area is obtained, making it possible to have sufficient antenna characteristics. Note that in the RF ground conductor 13 branched in two directions, a combination with the chip antenna 2 as an antenna portion brings about a bipolar-antenna-like state. Therefore, it is assumed that a length close to ¼ of an antenna operating wavelength is formed as an electrical length, thus improving the antenna characteristics.

Furthermore, the antenna apparatus of the present embodiment has the RF ground conductor 13 branched in an inverted L-shape. Therefore, it is possible to effectively use the surface of the substrate 1 by arranging the first ground portion 19A and the second ground portion 19B respectively along a short edge and a long edge of the substrate 1. Especially, the circuit ground conductor 4 is formed on the substrate 1 together with the RF ground conductor 13. This makes it possible to secure a sufficient area of the circuit ground conductor 4 while maintaining the antenna characteristics. Furthermore, the RF ground conductor 13 is branched in directions orthogonal to each other. This can contribute to the antenna characteristics in an omnidirectional manner.

As another example of the present embodiment, the second ground portion 19B may be arranged on the opposite side of the link conductor 14 (in the figure, on the right side of the circuit ground conductor 4) along the circuit ground conductor 4, as shown in FIG. 3.

Next is a description of another embodiment of an antenna apparatus according to the present invention. Note that in the following description of the embodiment, identical constituent elements to those described in the above embodiment are designated with identical reference numerals, and description thereof is omitted.

Figure 4:
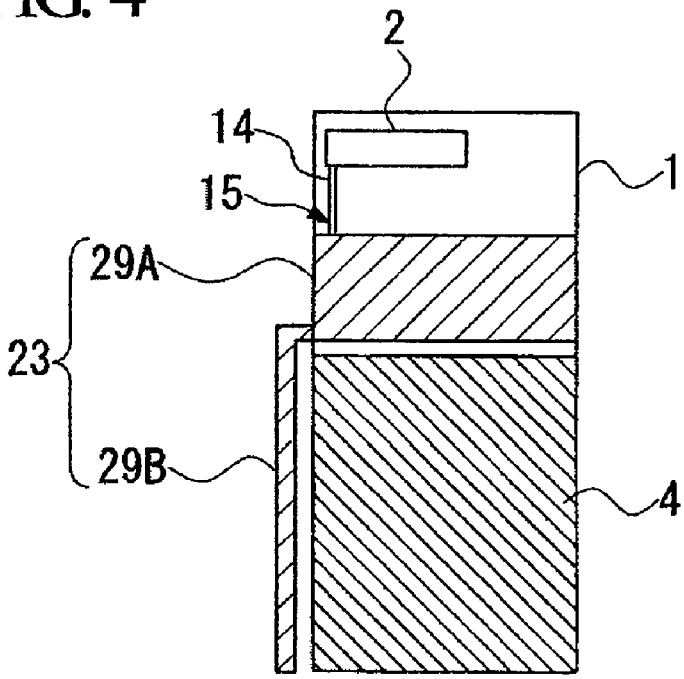
FIG. 4 is a plan view showing an antenna apparatus of a second embodiment according to the present invention.

The difference between this embodiment and the previous embodiment lies in the following point. While in the above embodiment, both of the first ground portion 19A and the second ground portion 19B that constitute the RF ground conductor 13 are pattern-formed on the substrate 1, the antenna apparatus of this embodiment is made of: a substrate ground portion 29A where an RF ground conductor 23 is formed on a substrate 1; and an external ground portion 29B a base end of which is connected to the substrate ground portion 29A and extends outside the substrate 1 in a direction different from that of the substrate ground portion 29A, as shown in FIG. 4.

That is, in this embodiment, the RF ground conductor 23 is made of: the substrate ground portion 29A that is pattern-formed on the substrate 1, similarly to the first ground portion 19A; and the external ground portion 29B whose base end is connected to the left edge of the substrate ground portion 29A and which extends along the circuit ground conductor 4 in a direction orthogonal to an extension direction of the substrate ground portion 29A.

As the above external ground portion 29B, a flexible substrate, a metal wire, or a metal-made adhesive tape where a conductor is formed is adopted.

In this manner, in this embodiment, the RF ground conductor 23 is made of: the substrate ground portion 29A; and the external ground portion 29B. Therefore, in the case where a sufficient ground plane is not available on the surface of the substrate 1 for securing the circuit ground conductor 4 or for other purposes, it is possible to secure a ground length by use of the external ground portion 29B outside the substrate 1, to thereby obtain favorable antenna characteristics.

EXAMPLES

Next is a specific description of the results confirming the effect of the antenna apparatus according to the present invention by use of a simulation tool.

As calculation conditions for the simulation tool, the regulator circuit constants of the first inductor 16 to the third inductor 18 in the frequency regulation circuit 15 were respectively made A, B, and C. Furthermore, as constituent materials of the respective parts, an FR-4 with a specific inductive capacity of 4.9 was used in the substrate 1, and also an alumina base material with a specific inductive capacity of 9 was used in the chip antenna 2. The conductors in the conductor pattern and the surface of the substrate 1 were perfect conductors.

Figure 5:
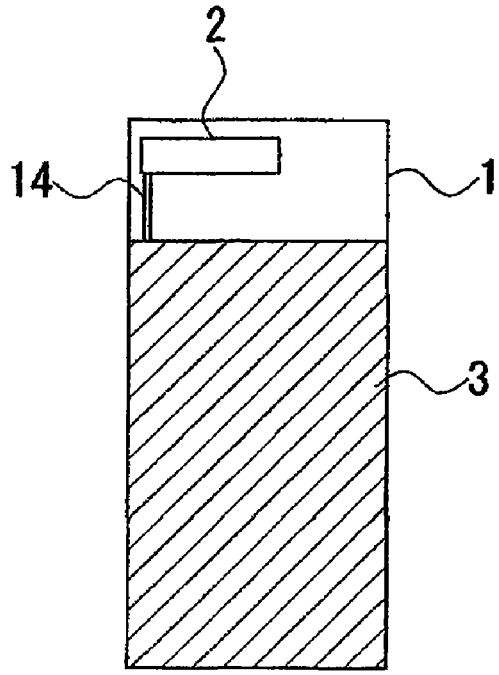
FIG. 5 is a plan view showing an example of an ideal antenna apparatus.
Figure 6:
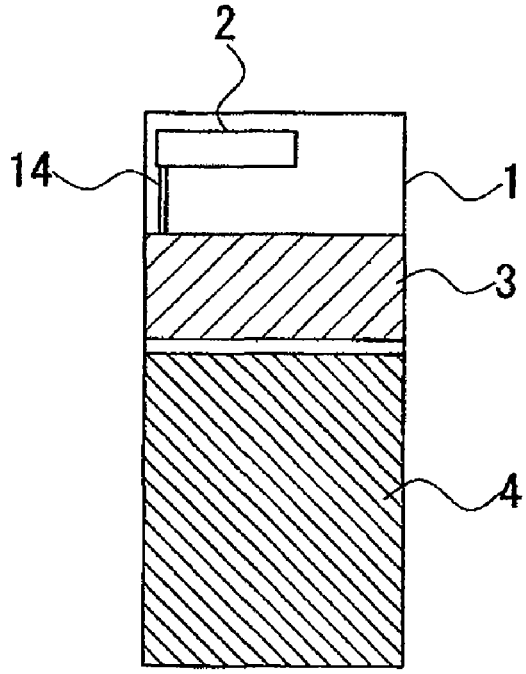
FIG. 6 is a plan view showing an example of a conventional antenna apparatus according to the present invention.

Table 1 below shows the results of the evaluation confirming the effect by the simulation tool performed on the above-mentioned embodiment (Invention 1) and another example of an embodiment (Invention 2) based on the above calculation conditions. Table 1 also shows the results of the simulation similarly performed on an ideal configuration (Ideal Example) shown in FIG. 5 and a conventional configuration (Conventional Example) shown in FIG. 6.

TABLE 1

| | Regulator circuit constant | | | Return | Resonant | Radiation efficiency |
|---|---|---|---|---|---|---|
| Item | A | B | C | loss | frequency | |
| Conventional Example | 6 nH | 240 nH | 10 nH | −30 dB | 430 MHz | 10% |
| Ideal Example | 6 nH | 240 nH | 14 nH | −21 dB | 430 MHz | 26% |
| Invention 1 | 5 nH | 240 nH | 11 nH | −23 dB | 430 MHz | 25% |
| Invention 2 | 5 nH | 240 nH | 10 nH | −20 dB | 430 MHz | 24% |

As shown in Table 1 above, both Invention 1 and Invention 2 showed improved antenna characteristics compared with Conventional Example. An effect substantially the same as that of Ideal Example was confirmed.

The present invention is not limited to the above respective embodiments and various modifications can be made as long as they do not depart from the spirit or scope of this invention.

For example, in the frequency regulation circuit 15, the first inductor 16 to the third inductor 18 with an inductance component as a lumped constant element are used. However, the component is not limited to an inductance component. Capacitors with a capacitance component may be used. Alternatively, these may be combined.

Furthermore, as a base material of the chip antenna 2, an alumina is used, which is a dielectric material. However, a magnetic material or a composite material combining a dielectric material and a magnetic material may be used.

Furthermore, the above RF ground conductors 13 and 23 are branched to extend in two directions. However, the RF ground conductor may be branched to extend in three or more directions.

What is claimed is:

1. An antenna apparatus, comprising:

a substrate;

an RF ground conductor which is formed in an inverted L-shape so as to be branched to extend in at least two directions orthogonal to each other, at least a part of which RF ground conductor is formed on a surface of the substrate so as to be arranged along a short edge and a long edge of the substrate, the RF ground conductor functioning as an antenna ground plane; and an antenna portion, one end of which is connected to the RF ground conductor, a circuit ground conductor functioning as a digital circuit ground and formed on the surface of the substrate; and a part of the RF ground conductor which extends in a direction spaced apart from the antenna portion is arranged along the circuit ground conductor.

2. The antenna apparatus according to claim 1, wherein the antenna portion is a chip antenna installed on the substrate, and the RF ground conductor has, on the substrate: a first ground portion that extends along the chip antenna; and a second ground portion that extends in a direction orthogonal to an extension direction of the first ground portion and also in a direction spaced apart from the first ground portion and the chip antenna; and the second ground portion is arranged along the circuit ground conductor.

3. The antenna apparatus according to claim 1, wherein the RF ground conductor includes: a substrate ground portion formed on the substrate; and an external ground portion, a base end of which is connected to the substrate ground portion and extends outside the substrate in a direction different from that of the substrate ground portion; and the external ground portion is arranged along the circuit ground conductor.

* * * * *